US011398339B2

(12) United States Patent
Yasuda

(10) Patent No.: US 11,398,339 B2
(45) Date of Patent: Jul. 26, 2022

(54) SURFACE MOUNTING COIL DEVICE AND ELECTRONIC EQUIPMENT

(71) Applicant: TDK CORPORATION, Tokyo (JP)

(72) Inventor: Masatoshi Yasuda, Tokyo (JP)

(73) Assignee: TDK CORPORATION, Tokyo (JP)

( * ) Notice: Subject to any disclaimer, the term of this patent is extended or adjusted under 35 U.S.C. 154(b) by 594 days.

(21) Appl. No.: 16/290,595

(22) Filed: Mar. 1, 2019

(65) Prior Publication Data

US 2019/0279808 A1 Sep. 12, 2019

(30) Foreign Application Priority Data

Mar. 6, 2018 (JP) ..... JP2018-039961

(51) Int. Cl.

| | |
|---|---|
| ***H01F 27/32*** | (2006.01) |
| ***H01F 27/28*** | (2006.01) |
| ***H01F 27/29*** | (2006.01) |
| ***H01F 27/30*** | (2006.01) |
| ***H01F 27/36*** | (2006.01) |

(52) U.S. Cl.

CPC ..... *H01F 27/2804* (2013.01); *H01F 27/288* (2013.01); *H01F 27/2823* (2013.01); *H01F 27/292* (2013.01); *H01F 27/306* (2013.01); *H01F 27/325* (2013.01); *H01F 27/36* (2013.01)

(58) Field of Classification Search

CPC ..... H01F 27/34; H01F 27/38

USPC ..... 336/84 C, 84 M

See application file for complete search history.

(56) References Cited

U.S. PATENT DOCUMENTS

| | | | | |
|---|---|---|---|---|
| 5,489,884 | A * | 2/1996 | Heringer | H01F 17/041 336/210 |
| 5,592,138 | A * | 1/1997 | Tobben | H01F 27/263 336/210 |
| 9,293,246 | B1 * | 3/2016 | Folker | H01F 27/06 |
| 2019/0006086 | A1 * | 1/2019 | Forster | H01F 17/04 |

FOREIGN PATENT DOCUMENTS

| | | | |
|---|---|---|---|
| JP | H09-007858 | A | 1/1997 |

* cited by examiner

*Primary Examiner* — Ronald Hinson

(74) *Attorney, Agent, or Firm* — Oliff PLC

(57) ABSTRACT

A surface mounting coil device includes a bobbin including a hollow tube-shaped hollow tube portion and a terminal block portion connected to the hollow tube portion and provided with a terminal installed on a mounting substrate during mounting, a wire member including a winding portion wound around the hollow tube portion, both ends of the wire member being electrically connected to the terminal, a core including a middle leg portion passing through the hollow tube portion and attached to the bobbin, and a shield member including a shielding portion positioned in an outer diameter direction of the winding portion, an engagement portion engaged so as to be relatively movable along a mounting direction with respect to the bobbin, and an installation portion connected directly or via the shielding portion with respect to the engagement portion and installed on the mounting substrate during mounting.

5 Claims, 7 Drawing Sheets

SURFACE MOUNTING COIL DEVICE AND ELECTRONIC EQUIPMENT

BACKGROUND OF THE INVENTION

1. Field of the Invention

The present invention relates to a surface mounting coil device used after being mounted on a circuit substrate or the like and electronic equipment in which a surface mounting coil is mounted.

2. Description of the Related Art

A technique for attaching a shield member for suppressing magnetic flux leakage to the periphery of a coil device to the coil device has been proposed with regard to coil devices used for electronic equipment and the like. It is preferable that the shield member is electrically connected with respect to an earth (ground wiring) of the electronic equipment or a substrate. In addition, in some cases, shield member-based magnetic flux leakage suppression is required with regard to coil devices for surface mounting as well.

SUMMARY OF THE INVENTION

However, the shield member according to the related art, which is attached to a substrate separately from the coil device, causes production efficiency-related problems because the two components need to be mounted. In addition, the following problems arise during shield member connection to an earth or the like in a case where a method for integrating the shield member in the coil device before mounting is adopted, particularly in the case of application to a coil device to be surface-mounted.

In other words, in a case where a technique for connecting the shield member with respect to an earth terminal in the coil device before mounting is adopted, the earth terminal and the shield member need to be wired in a coil device manufacturing process. Accordingly, such shield member-equipped coil devices are problematic in terms of production efficiency and cost.

Also conceivable regarding coil device manufacturing processes is a technique for not connecting the shield member to the earth terminal in the coil device by means of simple shield member-coil device integration. Conceivable for adopting such a technique and earthing the shield member is the shield member being directly wired onto a mounting substrate with the shield member given a portion for installation onto the mounting substrate. However, for the direct shield member wiring onto the mounting substrate, the shield member and the coil device need to be integrated with both the installation portion of the shield member and the terminal of the coil device aligned so as to reach an appropriate height with respect to the mounting substrate.

In such a coil device, no sufficient assembly tolerance can be ensured with ease when both the height of the installation portion of the shield member and the height of the terminal of the coil device are attempted to be kept within an allowable error range. In addition, once the positional accuracy between the installation portion of the shield member and the terminal of the coil device becomes insufficient, problems may arise in the form of, for example, the installation portion or the terminal floating from the mounting substrate to result in a mounting failure. In addition, in a case where a technique for simultaneously wiring the installation portion of the shield member and the terminal of the coil component on the mounting substrate is adopted, connection to many land patterns needs to be performed, and thus a connection failure attributable to contact floating or the like may become more likely as, for example, the preliminary solder that is formed in each land pattern is not uniform.

The invention has been made in view of such circumstances and provides a surface mounting coil device capable of preventing a connection failure during mounting and satisfactory in terms of productivity and electronic equipment including such a surface mounting coil device.

In order to achieve the above object, a surface mounting coil device according to the invention includes a bobbin including a hollow tube-shaped hollow tube portion and a terminal block portion connected to the hollow tube portion and provided with terminals installed on a mounting substrate after mounting, a wire member including a winding portion wound around the hollow tube portion, both ends of the wire member being electrically connected to the terminals respectively, a core including a middle leg portion passing through the hollow tube portion and attached to the bobbin, and a shield member including a shielding portion positioned in an outer diameter direction of the winding portion, an engagement portion engaged so as to be relatively movable along a mounting direction with respect to the bobbin, and an installation portion connected directly or via the shielding portion with respect to the engagement portion and installed on the mounting substrate after mounting.

In the surface mounting coil device according to the invention, the engagement portion of the shield member is engaged so as to be relatively movable along the mounting direction with respect to the bobbin. Accordingly, when the coil device is installed on the mounting substrate, both the installation portion of the shield member and the terminal of the bobbin can be disposed at an appropriate height with respect to each land pattern of the mounting substrate. Accordingly, the surface mounting coil device is capable of preventing the problem of the installation portion or the terminal of the coil device floating from the land pattern of the mounting substrate when the surface mounting coil device is installed on the mounting substrate and effectively preventing a connection failure of the coil device.

In addition, the height of the installation portion of the shield member and the height of the terminal of the coil device do not have to coincide with each other during manufacturing of the surface mounting coil device, and thus a sufficient assembly tolerance can be easily ensured and productivity is ensured to a satisfactory extent with the surface mounting coil device. In addition, no wiring needs to be performed on the shield member and the terminal, and thus the productivity of the surface mounting coil device is excellent in this regard as well.

For example, the shielding portion may include a top plate portion positioned above the winding portion, which is one side in the mounting direction, and first and second side plate portions respectively connected to both ends of the top plate portion and extending downward, which is the other side in the mounting direction, from the top plate portion.

The installation portion may include first and second installation portions respectively connected to lower ends of the first and second side plate portions.

By the shielding portion having the top plate portion and the first and second side plate portions, the shielding portion is capable of surrounding the winding portion from three directions. Accordingly, the surface mounting coil device is capable of more effectively preventing magnetic flux leakage. In addition, a mounting machine is capable of mounting the surface mounting coil device by adsorbing the top plate portion, and thus the surface mounting coil device is easily transported by the mounting machine.

For example, the top plate portion may be rectangular and tabular and the first and second side plate portions may be respectively connected to a pair of opposite sides of the top plate portion.

The engagement portion may include first and second engagement portions respectively connected to the other pair of opposite sides of the top plate portion.

In the surface mounting coil component, the first and second engagement portions are capable of sandwiching the bobbin from both sides, and thus the bobbin and the shield member can be more reliably engaged. In addition, the first and second engagement portions and the first and second side plate portions are connected independently with respect to the top plate portion, and thus a variation in the length from the top plate portion to the installation portion (total length of the shield member in the mounting direction) can be suppressed by the shapes of the first and second side plate portions and the installation portion being simplified. As a result, a shape variation after mounting can be suppressed.

For example, the core may include a first core part and a second core part separate from each other.

The surface mounting coil device according to the invention may further include a tape wound around an outer periphery of the core and fixing the first core part and the second core part to each other.

The coil device that has the tape and the core can be assembled with ease, and thus the amount of magnetic flux leakage can be adjusted with ease.

Electronic equipment according to the invention includes a mounting substrate including a pair of land patterns, a conductor portion interconnecting the pair of land patterns, and the other land pattern different from the pair of land patterns, a bobbin including a hollow tube-shaped hollow tube portion and a terminal block portion connected to the hollow tube portion and provided with terminals installed in the other land pattern of the mounting substrate, a wire member including a winding portion wound around the hollow tube portion, both ends of the wire member being electrically connected to the terminals respectively, a core including a middle leg portion passing through the hollow tube portion and attached to the bobbin, and a shield member including a shielding portion having a top plate portion positioned above the winding portion, which is one side in the mounting direction, an engagement portion engaged so as to be relatively movable along the mounting direction with respect to the bobbin, and a pair of installation portions connected directly or via the shielding portion with respect to the engagement portion and installed in the pair of land patterns of the mounting substrate, in which the top plate portion and the conductor portion are disposed so as to sandwich the winding portion from both sides of the mounting direction.

The electronic equipment has the engagement portion engaged so as to be relatively movable with respect to the bobbin, and thus both the terminal and the installation portion come into contact with and are mounted in the land pattern of the mounting substrate in an appropriate manner. In addition, since the installation portion is appropriately installed with respect to the land pattern, the problem of the shield member floating from the mounting substrate can be appropriately prevented even in a case where the periphery of the bobbin, the core, or the like is filled with a potting resin. In addition, since the top plate portion of the shield member and the conductor portion of the mounting substrate are disposed so as to sandwich the winding portion of the wire member from both sides in the mounting direction, leakage magnetic flux generation to both mounting direction sides can be prevented in a particularly effective manner.

DETAILED DESCRIPTION OF THE PREFERRED EMBODIMENTS

Figure 1:
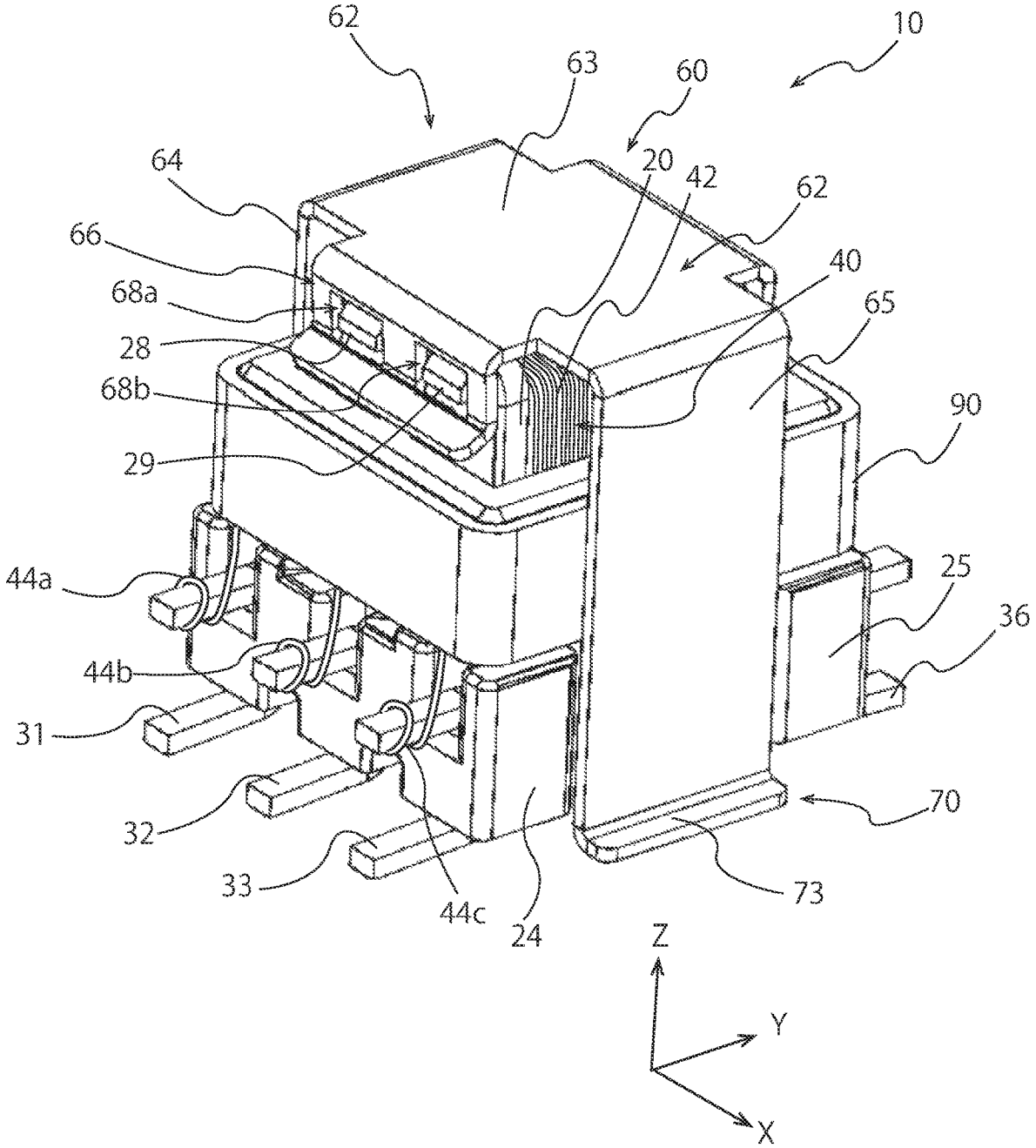
FIG. 1 is a schematic perspective view of a surface mounting coil device according to an embodiment of the invention.

Hereinafter, the invention will be described based on an embodiment illustrated in the drawings.

A transformer 10 as a surface mounting coil device according to the present embodiment illustrated in FIG. 1 is used after being mounted on a mounting substrate included in, for example, electronic equipment for household or industrial use or in-vehicle electronic equipment mounted in a vehicle such as an electric vehicle (EV: electric transport equipment). The transformer 10 can be surface-mounted with respect to the mounting substrate by a mounting machine adsorbing and transporting the upper surface (a top plate portion 63) of the transformer 10. Alternatively, the transformer 10 may be used after being mounted on the substrate by a method other than surface mounting.

Figure 2:
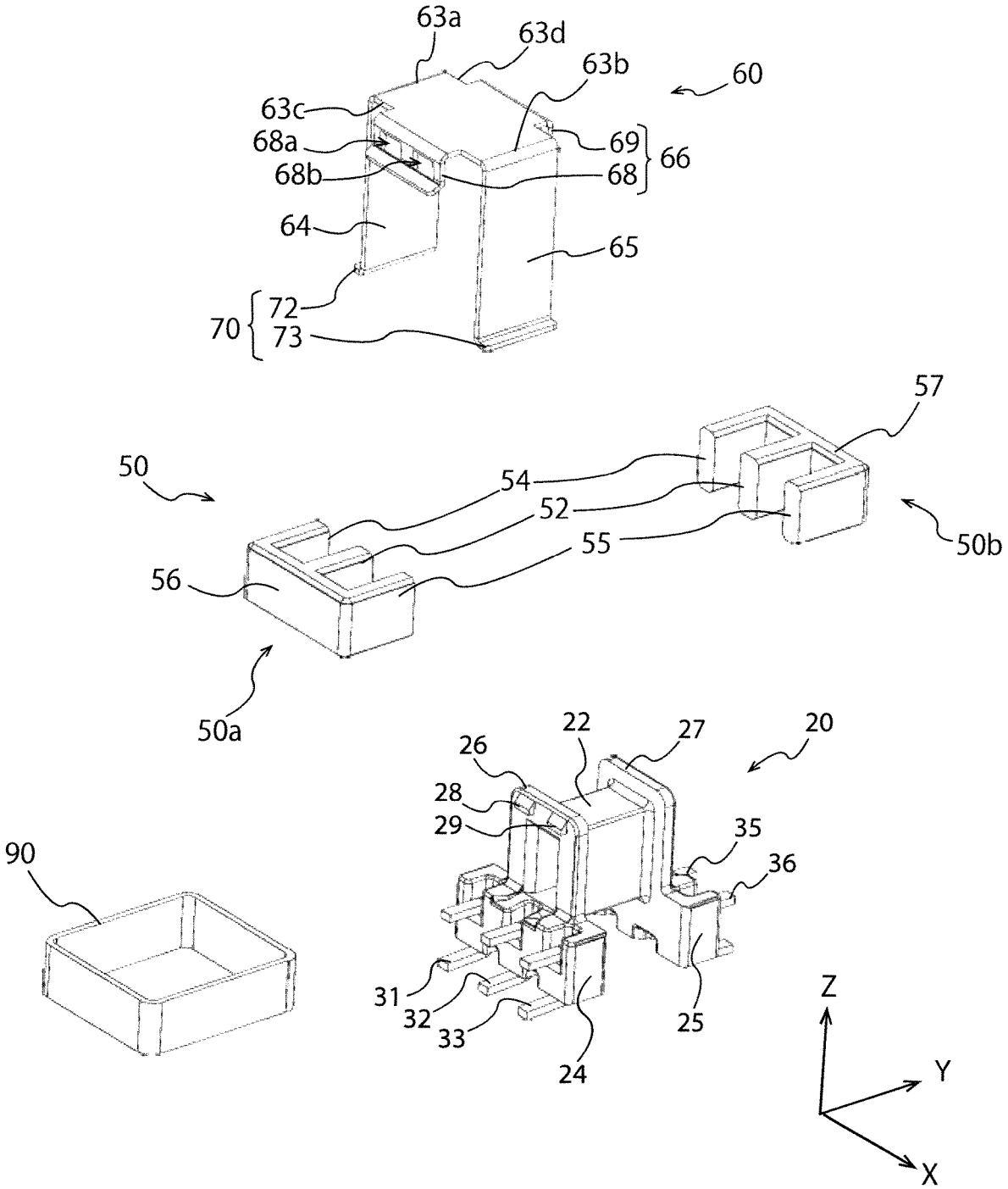
FIG. 2 is an exploded perspective view of the surface mounting coil device illustrated in FIG. 1.

The transformer 10 has a wire member 40 having, for example, a conducting wire through which a current flows, a bobbin 20 around which the wire member 40 is wound, a core 50, a shield member 60, and a tape 90. As illustrated in FIG. 2, which is an exploded perspective view of the transformer 10, the transformer 10 is manufactured by the wire member 40 (see FIGS. 1 and 3), the core 50, the tape 90, and the shield member 60 being combined with respect to the bobbin 20. The wire member 40 is not illustrated in FIG. 2.

Figure 3:
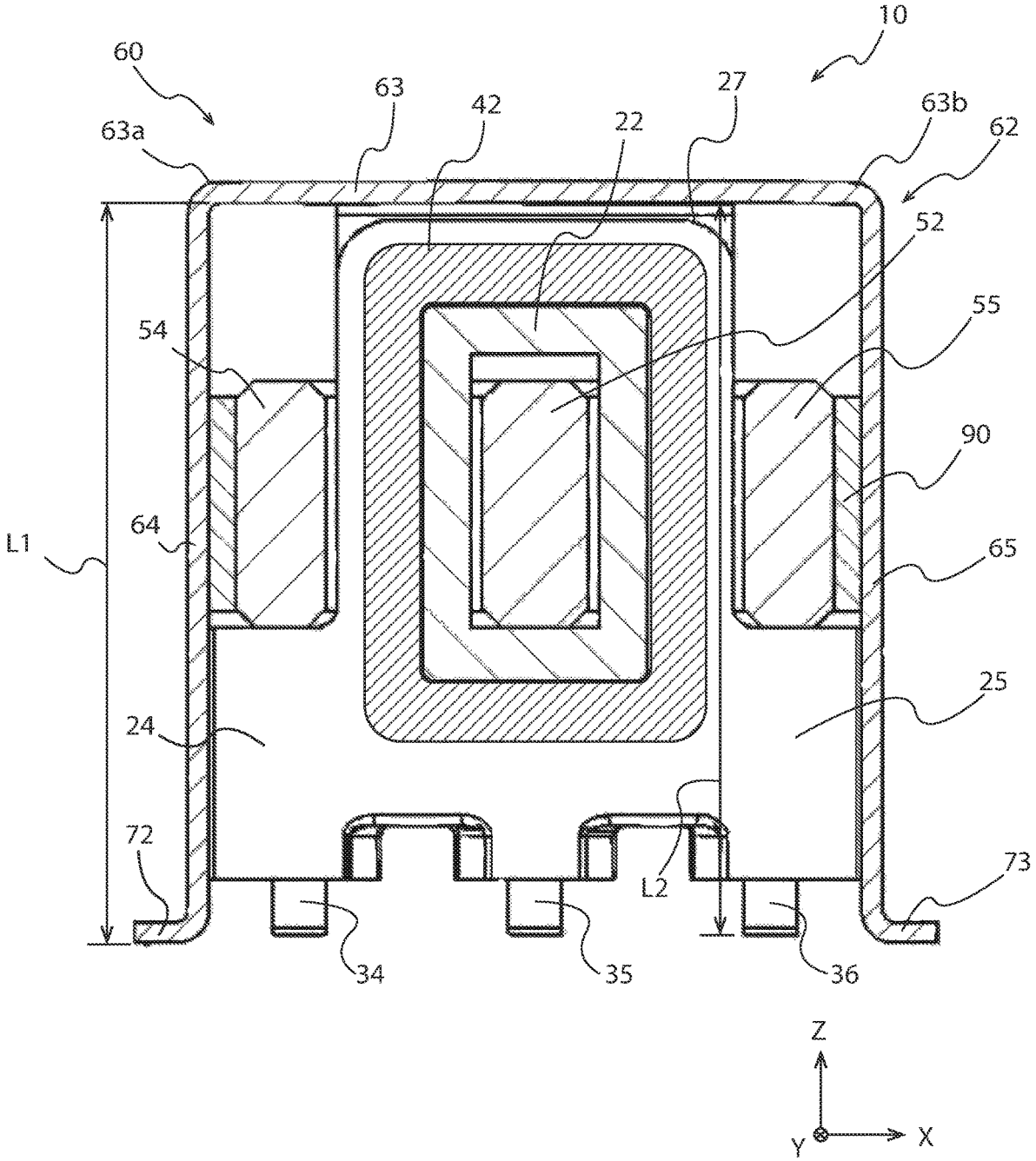
FIG. 3 is a schematic cross-sectional view of the coil device illustrated in FIG. 1.
Figure 4B:
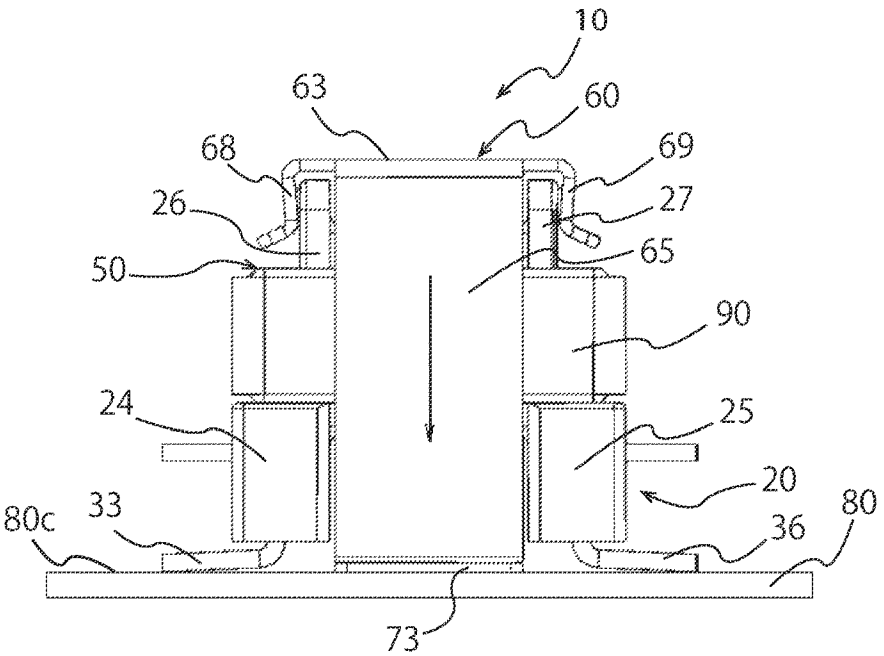
FIGS. 4A and 4B are conceptual diagrams illustrating a process for mounting the surface mounting coil device illustrated in FIG. 1.

As illustrated in FIG. 4B, in the transformer 10, the lower ends of terminals 33 and 36 and the lower end of an installation portion 70 (second installation portion 73) in the shield member 60 are installed in land patterns 83, 86, and 88 (see FIG. 6) provided on a mounting surface 80*c* of a mounting substrate 80. As illustrated in FIGS. 1 to 4A and 4B, in the description of the transformer 10, the Z axis direction is the mounting direction that coincides with the normal direction of the mounting surface, the Y axis direction is the winding axis direction of the wire member illustrated in FIG. 1 and is perpendicular to the mounting direction, and the X axis direction is perpendicular to the Z axis direction and the Y axis direction.

As illustrated in FIG. 2, the bobbin 20 included in the transformer 10 has a hollow tube-shaped hollow tube portion 22, a terminal block portion 24 connected to the hollow tube portion 22 and provided with a terminal 31, a terminal 32, and the terminal 33, a terminal block portion 25 provided with a terminal 34, a terminal 35, and the terminal 36, and flange portions 26 and 27. The hollow tube portion 22 has a substantially quadratic pole-shaped outer shape extending in parallel to the mounting surface 80*c* along the Y axis direction. Connected to both ends of the hollow tube portion 22 are the flange portions 26 and 27 protruding in the Z axis positive direction and the X axis direction from the hollow tube portion 22 and the terminal block portions 24 and 25 protruding in the Z axis negative direction from the hollow tube portion 22.

Figure 4A:
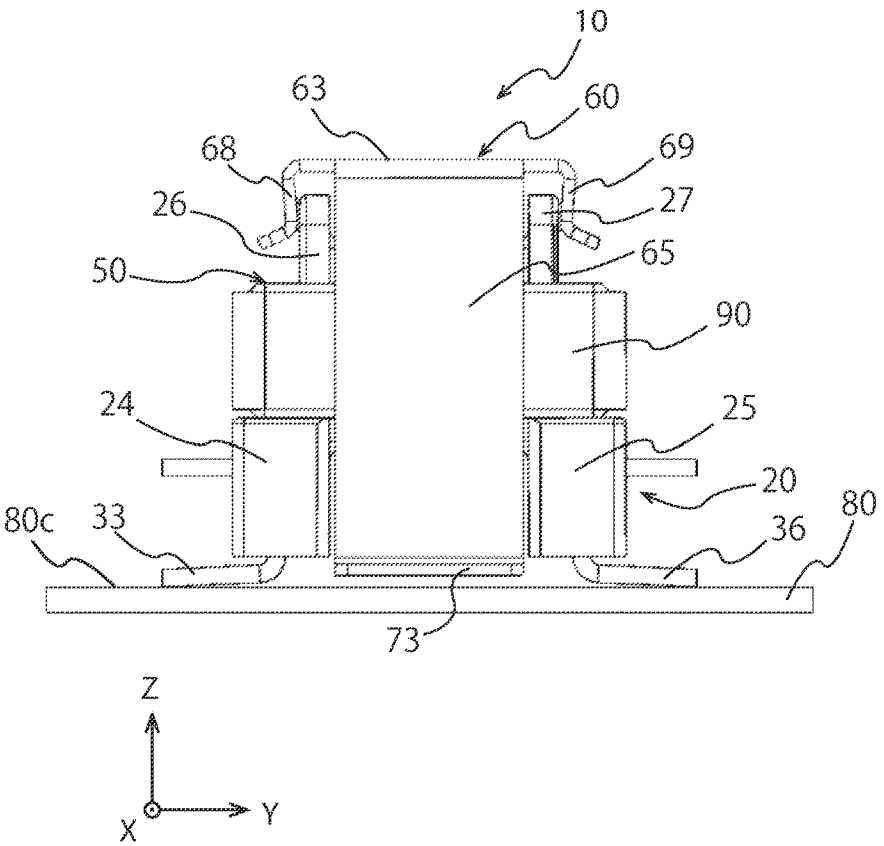

As illustrated in FIG. 2, the terminal block portion 24 of the bobbin 20 is connected to the lower part of the hollow tube portion 22 that is on the Y axis negative direction side. The terminals 31, 32, and 33 provided in the terminal block portion 24 have a substantially U shape with both end portions facing the Y axis negative direction side. The terminals 31, 32, and 33 are insert-molded in the terminal block portion 24 of the bobbin 20 with both end portions exposed from the terminal block portion 24. As illustrated in FIG. 1, wire end portions 44*a*, 44*b*, and 44*c*, which are both ends of the wire member 40, are connected to the upper end portions of the terminals 31, 32, and 33, respectively. As illustrated in FIGS. 4A and 4B, the lower end portions of the terminals 31, 32, and 33 are installed on the mounting substrate 80 during mounting and connected to a land pattern 81, a land pattern 82, and the land pattern 83 illustrated in FIG. 6, respectively.

As illustrated in FIG. 3, the terminal block portion 25 of the bobbin 20 is connected to the lower part of the hollow tube portion 22 that is on the Y axis positive direction side. The terminals 34, 35, and 36 provided in the terminal block portion 25 have a substantially U shape with both end portions facing the Y axis positive direction side. Similarly to the terminals 31, 32, and 33, the terminals 34, 35, and 36 are insert-molded in the terminal block portion 25 of the bobbin 20 with both end portions exposed from the terminal block portion 25. Wire end portions 44*d* and 44*f* (see FIG. 5), which are both ends of the wire member 40, are connected to the upper end portions of the terminals 34 and 36, respectively. The lower end portions of the terminals 34 and 36 are installed on the mounting substrate 80 during mounting and connected to a land pattern 84 and the land pattern 86 illustrated in FIG. 6, respectively.

The terminal block portion 24 provided with the terminals 31, 32, and 33 and the terminal block portion 25 provided with the terminals 34, 35, and 36 have symmetrical shapes as illustrated in FIGS. 4A and 4B, and the bobbin 20 illustrated in FIG. 2 has a bilaterally symmetrical shape with respect to the center position of the hollow tube portion 22. Alternatively, the bobbin 20 may have an asymmetrical shape.

As illustrated in FIG. 2, an engagement receiving portion 28 is formed in the flange portion 26 connected to the Y axis negative direction side of the hollow tube portion 22. The engagement receiving portion 28 and an engagement receiving portion 29 are the parts of the flange portion 26 that protrude in the Z axis positive direction from the hollow tube portion 22 and are formed on the outside surface of the flange portion 26 (surface on the Y axis negative direction side). As illustrated in FIGS. 1 and 2, the engagement receiving portions 28 and 29 are constituted by two projections protruding to the Y axis negative direction side and engaged with two engagement holes 68*a* and 68*b* formed in a first engagement portion 68 of the shield member 60.

Although not illustrated in FIG. 2, the flange portion 27 connected to the Y axis positive direction side of the hollow tube portion 22 has a shape substantially symmetrical to the flange portion 26 and an engagement receiving portion (not illustrated) having a shape symmetrical to the engagement receiving portions 28 and 29 of the flange portion 26 formed in the flange portion 27. Two engagement holes (not illustrated) formed in a second engagement portion 69 of the shield member 60 are engaged with the engagement receiving portion of the flange portion 26.

The wire member 40 illustrated in FIG. 1 has a winding portion 42 wound around the outer periphery of the hollow tube portion 22 of the bobbin 20 illustrated in FIG. 2. As illustrated in FIG. 1, both ends of the wire member 40 are drawn out from the winding portion 42 and electrically connected with respect to the terminals 31 to 36 of the bobbin 20. The wire member 40 may be constituted by a single wire or a stranded wire such as a litz wire. Although the wire diameter of the wire that constitutes the wire member 40 is not particularly limited, it is preferable that the wire diameter ranges from 1.0 to 4.0 mm. The wire member 40 is constituted by a conductive wire such as a metal wire or an insulated wire in which a conductive wire is insulated.

Figure 5:
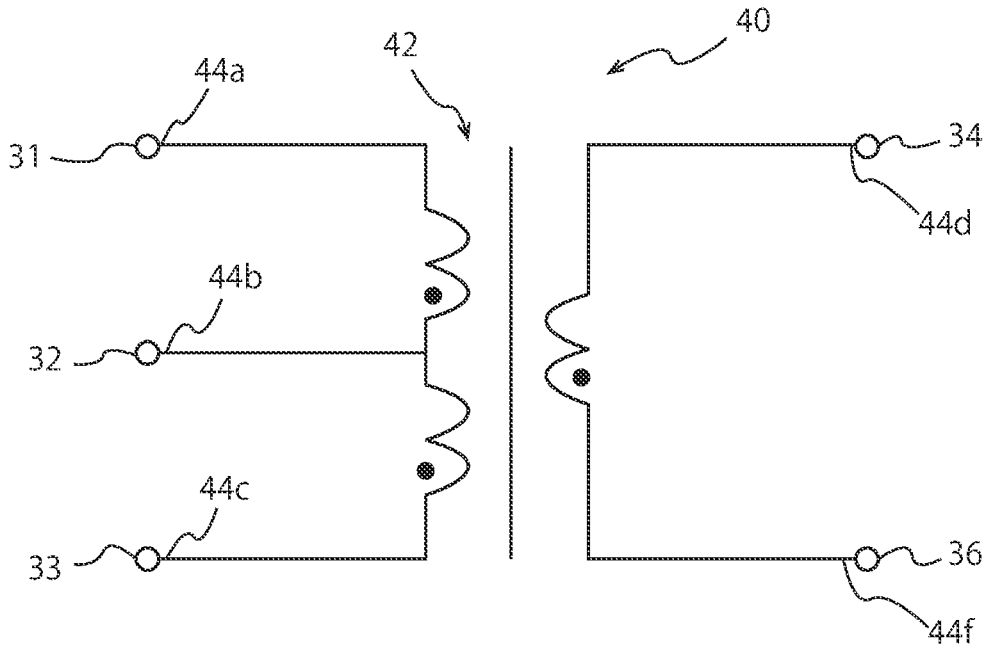
FIG. 5 is a circuit diagram of the surface mounting coil device illustrated in FIG. 1.

FIG. 5 is a circuit diagram of the transformer 10 illustrated in FIG. 1. The wire member 40 is constituted by three wires with the respective end portions of the wires connected to the terminals 31, 32, 33, 34, and 36. Of the terminals 31 to 36 of the bobbin 20, one wire is connected to the terminals 31, 33, 34, and 36, two wires are connected to the terminal 32, and no wire is connected to the terminal 35. The number of terminals provided in the bobbin 20, the number of wires wound around the hollow tube portion 22, and the position of wire connection to each of the terminals 31 to 35 can be appropriately changed.

The core 50 is attached to the bobbin 20 as illustrated in FIGS. 1 and 2. As illustrated in FIG. 2, the core 50 has a first core part 50*a* and a second core part 50*b*, which are separate from each other. Each of the first core part 50*a* and the second core part 50*b* has a substantially E shape when viewed from the mounting direction and has a substantially symmetrical shape. The first core part 50*a* and the second core part 50*b* constitute the core 50 by being combined such that a middle leg portion 52 joined at the center in the X axis direction is inserted through the hollow tube portion 22 of the bobbin 20. The first core part 50*a* and the second core part 50*b* are fixed to each other by the tape 90 wound around the outer periphery of the core 50. A gap material may be provided at the butt part between the first core part 50*a* and the second core part 50*b*.

As illustrated in FIGS. 1 and 2, the core 50 has the middle leg portion 52 passing through the hollow tube portion 22, side leg portions 54 and 55 disposed on both sides of the middle leg portion 52 in the X axis direction so as to sandwich the middle leg portion 52, and connecting portions 56 and 57 connecting the respective X axis direction end portions of the middle leg portion 52 and the side leg portions 54 and 55. As illustrated in FIG. 3, the side leg portion 54 is installed on the upper surface of the terminal block portion 24 on the X axis negative direction side, the side leg portion 55 is installed on the upper surface of the terminal block portion 25 on the X axis positive direction side, and the side leg portions 54 and 55 and the middle leg portion 52 are arranged along the X axis direction.

As illustrated in FIGS. 1 to 3, in the core 50, the side leg portions 54 and 55 and the connecting portions 56 and 57 connect both ends of the middle leg portion 52 passing through the hollow tube portion 22 where the winding portion 42 is formed outside the winding portion 42 and the hollow tube portion 22 and form a magnetic circuit with regard to the magnetic flux that is generated by the current flowing through the wire member 40. The middle leg portion 52 and the side leg portions 54 and 55 extend in the Y axis direction, which is the winding axis direction of the winding portion 42, and are disposed substantially in parallel to each other. Although examples of the material of the core 50 include a soft magnetic material such as metal and ferrite, the material is not particularly limited.

As illustrated in FIG. 1, the shield member 60 is attached from above with respect to the bobbin 20 and has a shielding portion 62, an engagement portion 66, and the installation portion 70. The shielding portion 62 is positioned in the outer diameter direction of the winding portion 42 and prevents the magnetic flux generated by the current flowing through the wire member 40 from leaking to the outside of the transformer 10. The shielding portion 62 has the top plate portion 63 positioned above the winding portion 42 (positioned on the Z axis positive direction side), which is one side in the mounting direction, a first side plate portion 64 positioned on the X axis negative direction side with respect to the winding portion 42, and a second side plate portion 65 positioned on the X axis positive direction side with respect to the winding portion 42. All of the top plate portion 63, the first side plate portion 64, and the second side plate portion 65 are tabular except for the mutually connected parts of the top plate portion 63, the first side plate portion 64, and the second side plate portion 65.

As illustrated in FIG. 1, the top plate portion 63 constitutes the upper surface of the transformer 10. The first side plate portion 64 and the second side plate portion 65 are connected to both X axis direction end portions of the top plate portion 63 and extend downward (in the Z axis negative direction), which is the other side in the mounting direction, from the top plate portion 63. As illustrated in FIG. 2, the top plate portion 63 is substantially rectangular and tabular and the first and second side plate portions 64 and 65 are respectively connected to a pair of opposite sides 63*a* and 63*b*, which are on both sides of the top plate portion 63 in the X axis direction.

As illustrated in FIG. 2, the installation portion 70 in the shield member 60 has a first installation portion 72 connected to the lower end of the first side plate portion 64 (end portion on the Z axis negative direction side) and the second installation portion 73 connected to the lower end of the second side plate portion 65. The first and second installation portions 72 and 73 are connected via the shielding portion 62 with respect to the engagement portion 66 (described later).

The installation portion 70 constituted by the first and second installation portions 72 and 73 is positioned at the lowest part in the shield member 60 (on the Z axis negative direction side). As illustrated in FIGS. 4A and 4B, the installation portion 70 constituted by the first and second installation portions 72 and 73 is installed on the mounting substrate 80 during mounting. As illustrated in FIG. 3, the first and second installation portions 72 and 73 protrude outward from the lower ends of the first and second side plate portions 64 and 65 such that the tips of the first and second installation portions 72 and 73 are separated from the center of the transformer 10.

Alternatively to the shapes that are illustrated in FIG. 3, the first and second installation portions 72 and 73 may protrude inward from the lower ends of the first and second side plate portions 64 and 65 such that the tips of the first and second installation portions 72 and 73 approach the center of the transformer 10. Although the first and second installation portions 72 and 73 extend in the horizontal direction (XY plane direction), the shapes of the first and second installation portions 72 and 73 are not limited thereto. The first and second installation portions 72 and 73 may have any other shapes allowing the first and second installation portions 72 and 73 to be installed on the mounting substrate 80. The shapes include a shape extending obliquely downward and a bent shape.

As illustrated in FIG. 3, a Z axis direction length L1 from the lower surface of the top plate portion 63 to the lower ends of the first and second installation portions 72 and 73 is longer than a length L2 from the upper surfaces of the flange portions 26 and 27, which are the upper end of the bobbin 20, to the terminals 34, 35, and 36. Accordingly, by the mounting machine pushing the top plate portion 63 from above as illustrated in FIG. 4B, the first and second installation portions 72 and 73 are capable of coming into contact with the mounting surface 80*c* of the mounting substrate 80.

As illustrated in FIG. 2, the engagement portion 66 in the shield member 60 has the first engagement portion 68 and the second engagement portion 69. The first and second engagement portions 68 and 69 are connected to the other pair of opposite sides 63*c* and 63*d* in the top plate portion 63 (opposite sides on both Y axis direction sides), respectively. As illustrated in FIG. 1, the first and second engagement portions 68 and 69 are disposed so as to sandwich the vicinity of the upper end portion of the bobbin 20 from both Y axis direction sides, the first engagement portion 68 faces the flange portion 26 (see FIG. 2) of the bobbin 20, and the second engagement portion 69 faces the flange portion 27 of the bobbin 20.

As illustrated in FIG. 1, the engagement holes 68*a* and 68*b* engaged with the engagement receiving portions 28 and 29 formed in the flange portion 26 are formed in the first engagement portion 68. In the transformer 10, the engagement receiving portions 28 and 29 as projections are engaged with respect to the engagement holes 68*a* and 68*b* as through holes. As illustrated in FIG. 2, the second engagement portion 69 has a shape substantially symmetrical to the first engagement portion 68. Similarly to the first engagement portion 68, the second engagement portion 69 has an engagement hole engaged with the engagement receiving portion that is formed in the flange portion 27.

The engagement portion 66 constituted by the first and second engagement portions 68 and 69 is engaged so as to be relatively movable along the Z axis direction, which is the mounting direction, with respect to the bobbin 20. In other words, the Z axis direction opening length of the engagement holes 68*a* and 68*b* illustrated in FIG. 1 is longer than the Z axis direction length of the engagement receiving portions 28 and 29, and the engagement receiving portions 28 and 29 are capable of moving in the Z axis direction in the engagement holes 68*a* and 68*b*. The Y axis direction gap that is formed between the first engagement portion 68 and the second engagement portion 69 is substantially equal to the Y axis direction width of the flange portion 26 and the flange portion 27 except for the engagement receiving portions 28 and 29. Accordingly, the first and second engagement portions 68 and 69 do not elastically grip the bobbin 20 or the first and second engagement portions 68 and 69 grip the bobbin 20 with a weak force, to such an extent that the bobbin 20 is capable of sliding by the weight of the bobbin 20, in a case where the first and second engagement portions 68 and 69 grip the bobbin 20.

Figure 6:
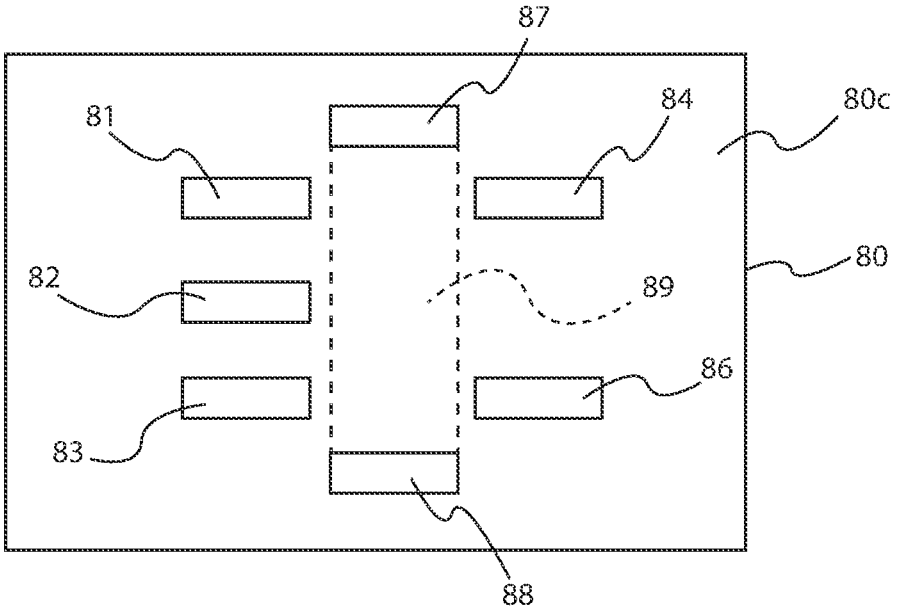
FIG. 6 is a conceptual diagram illustrating a land pattern of a mounting substrate for mounting the surface mounting coil device illustrated in FIG. 1.

FIGS. 4A and 4B are conceptual diagrams illustrating a process for mounting the transformer 10 on the mounting substrate 80 by using the mounting machine. As illustrated in FIG. 6, the mounting substrate 80 has a pair of a land pattern 87 and the land pattern 88 in which the first and second installation portions 72 and 73 of the shield member 60 are installed and the other land patterns 81, 82, 83, 84, and 86 different from the pair of land patterns 87 and 88. The terminals 31, 32, 33, 34, and 35 are installed in the land patterns 81, 82, 83, 84, and 86. The mounting machine transports the transformer 10 to the Z axis positive direction side of the mounting surface 80*c*, where the land patterns 81 to 84 and 86 to 88 illustrated in FIG. 6 are formed.

Illustrated in FIG. 4A is a state immediately after the transformer 10 is brought into contact with the mounting surface 80*c* by the mounting machine. The mounting machine holds the transformer 10 via the shield member 60 in transporting the transformer 10. More specifically, the mounting machine holds the transformer 10 by adsorbing the top plate portion 63 of the shielding portion 62 from above.

The bobbin 20 and the core 50 and the wire member 40 attached to the bobbin 20 are put into a state of hanging from the shield member 60 while the mounting machine transports the transformer 10 and the terminals 33 and 36 come into contact with the mounting substrate 80 as illustrated in FIG. 4A, and thus the bobbin 20 is positioned closest to the Z axis negative direction side relative to the shield member 60 by the weight of the bobbin 20. Accordingly, as illustrated in FIG. 4A, the lower end of the second installation portion 73 is positioned above the lower ends of the terminals 33 and 36 (on the Z axis positive direction side). In this state, the engagement receiving portions 28 and 29 of the bobbin 20 illustrated in FIG. 1 are in contact with the lower ends of the engagement holes 68*a* and 68*b* of the engagement portion 66. Although the first installation portion 72 is not illustrated in FIGS. 4A and 4B, the first installation portion 72 is similar to the second installation portion 73 with regard to the positional relationship in the Z axis direction with respect to the terminals 33 and 36.

As illustrated in FIG. 4A, once the mounting machine lowers the transformer 10 toward the mounting surface 80*c* at the mounting position, the terminals 33 and 36 provided in the bobbin 20 come into contact with the mounting surface 80*c* and are installed on the mounting substrate 80. In a state immediately after the contact between the terminals 33 and 36 and the mounting surface 80*c*, the second installation portion 73 of the shielding portion 62 is afloat with respect to the mounting surface 80*c* of the mounting substrate 80 and is not in contact with the mounting surface 80*c*.

After the state that is illustrated in FIG. 4A, the mounting machine further pushes the shielding portion 62 downward (to the Z axis negative direction side), and then the shielding portion 62 moves downward relative to, for example, the bobbin 20 and the terminals 33 and 36. Then, the second installation portion 73 of the shielding portion 62 comes into contact with the mounting surface 80*c* and is installed on the mounting substrate 80 as illustrated in FIG. 4B. Despite the contact between the second installation portion 73 of the shielding portion 62 and the mounting surface 80*c*, the contact state between the terminals 33 and 36 and the mounting surface 80*c* is maintained by the weight of the bobbin 20, the weight of the core 50, and the like. Accordingly, in the state that is illustrated in FIG. 4B, the lower ends of the terminals 33 and 36 and the lower end of the second installation portion 73 are aligned on the same plane. In this state, the engagement receiving portions 28 and 29 of the bobbin 20 illustrated in FIG. 1 are moved upward from the lower ends of the engagement holes 68*a* and 68*b* of the engagement portion 66 and are not in contact with the lower ends of the engagement holes 68*a* and 68*b*.

Figure 7:
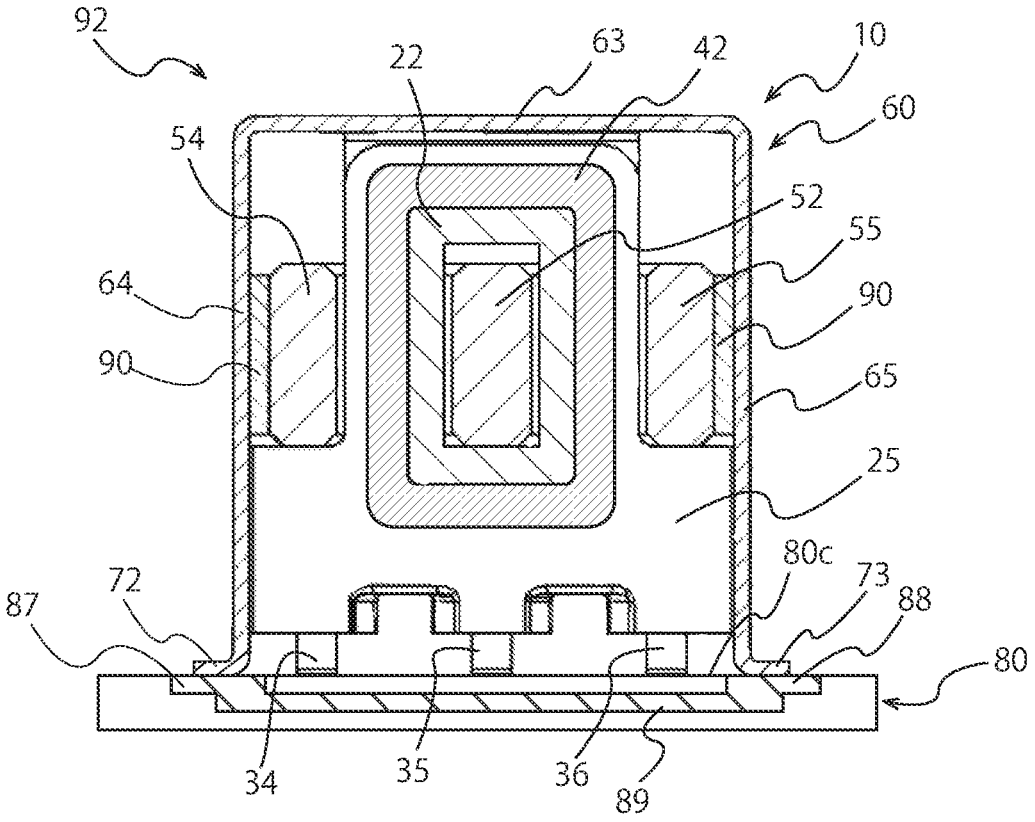
FIG. 7 is a schematic cross-sectional view of electronic equipment according to the embodiment of the invention.

After the transformer 10 is installed on the mounting substrate 80 in this manner, the transformer 10 is joined to and mounted on the mounting substrate 80 through, for example, a reflow process. FIG. 7 is a cross-sectional view of electronic equipment 92 having the transformer 10 mounted through the process that has been described with reference to FIGS. 4A and 4B. As described above, the pair of first and second installation portions 72 and 73 of the shielding portion 62 are installed in the pair of land patterns 87 and 88. The mounting substrate 80 has a conductor portion 89 interconnecting the pair of land patterns 87 and 88.

As illustrated in FIGS. 6 and 7, the conductor portion 89 is embedded in the mounting substrate 80 and is not exposed to the mounting surface 80*c*. In contrast, the pair of land patterns 87 and 88 and the land patterns 81, 82, 83, 84, and 86 in which the terminals 31, 32, 33, 34, and 36 of the transformer 10 are installed are exposed to the mounting surface 80*c* as illustrated in FIG. 6. The conductor portion 89 and the land patterns 81, 82, 83, 84, 86, 87, and 88 of the mounting substrate 80 are made of a good conductor such as metal. A print substrate and the like can be used as the mounting substrate 80. For example, a rigid substrate, a flexible substrate, and the like can be used as the mounting substrate 80. The substrates are not particularly limited.

The shield member 60 illustrated in FIGS. 1 and 2 is preferably made of a high-magnetic permeability material such as a metal material. Examples of the material include aluminum, iron, nickel, and stainless steel. The bobbin 20 illustrated in FIGS. 1 and 2 is produced by the conductive terminals 31 to 36 made of metal or the like being fixed by insert molding or the like to a plastic insulating material such as PPS, PET, PBT, LCP, and nylon.

As illustrated in FIG. 7, the top plate portion 63 of the shield member 60 and the conductor portion 89 of the mounting substrate 80 are disposed so as to sandwich the winding portion 42 and the core 50 from both sides in the mounting direction. Further, the first side plate portion 64 and the second side plate portion 65 are disposed so as to sandwich the winding portion 42 and the core 50 from both sides in the X axis direction orthogonal to the mounting direction. As a result, in the electronic equipment 92, the shield member 60 surrounds the three directions of the Z axis positive direction outside, the X axis positive direction outside, and the X axis negative direction outside of the winding portion 42, and the conductor portion 89 of the mounting substrate 80 is disposed on the Z axis negative direction outside of the winding portion 42. The electronic equipment 92 is capable of effectively preventing magnetic flux leakage from the winding portion 42 or the core 50.

As described above with reference to FIGS. 4A and 4B, in the transformer 10, the first and second engagement portions 68 and 69 of the shield member 60 are engaged so as to be relatively movable along the mounting direction with respect to the bobbin 20. Accordingly, when the transformer 10 is installed on the mounting substrate 80, both the first and second installation portions 72 and 73 of the shield member 60 and the terminals 31, 32, 33, 34, and 36 of the bobbin 20 can be disposed at an appropriate height with respect to each of the land patterns 81, 82, 83, 84, 86, 87, and 88 of the mounting substrate 80. Accordingly, the transformer 10 is capable of preventing the problem of the terminals 31, 32, 33, 34, and 36 or the installation portion 70 floating from the land patterns 81, 82, 83, 84, 86, 87, and 88 of the mounting substrate 80 when the transformer 10 is installed on the mounting substrate 80 and effectively preventing a connection failure of the transformer 10.

The height of the installation portion 70 of the shield member 60 and the heights of the terminals 31 to 36 do not have to be aligned during manufacturing of the transformer 10, and thus a sufficient assembly tolerance can be easily ensured and productivity is ensured to a satisfactory extent with the transformer 10. In addition, no wiring needs to be performed on the shield member 60 and the terminals 31 to 36, and thus the productivity of the transformer 10 is excellent in this regard as well.

As illustrated in FIGS. 4A and 4B, in the transformer 10, the first and second engagement portions 68 and 69 are engaged from both Y axis direction sides with respect to the engagement receiving portions 28 and 29 formed in the flange portions 26 and 27 of the bobbin 20. Accordingly, when the mounting machine transports the transformer 10, the shield member 60 is capable of supporting the core 50, the bobbin 20, the wire member 40, and the like in a balanced manner and from above in a state of being movable relative to the shield member 60.

Although not illustrated in FIG. 7, the electronic equipment 92 may have a potting resin covering the mounting surface 80*c* and the surface of the transformer 10. In electronic equipment having a potting resin, stress resulting from the thermal expansion of the potting resin or the like may act on the fixing part between the transformer 10 and the mounting substrate 80. In the transformer 10 illustrated in FIG. 7, the terminals 31, 32, 33, 34, and 36 and the installation portion 70 are reliably connected and fixed with respect to the land patterns 81, 82, 83, 84, 86, 87, and 88 of the mounting substrate 80. Accordingly, even in a case where the stress resulting from the thermal expansion of the potting resin or the like acts on the fixing part, it is possible to effectively prevent the problem of the stress resulting in a connection failure or the like.

Although the surface mounting coil device and the electronic equipment according to the invention have been described above based on the embodiment, the invention is not limited to the embodiments. It is a matter of course that many other embodiments, modification examples, and the like are included in the invention. For example, the shielding portion 62 in the shield member 60 is not limited to one having the top plate portion 63 and the first and second side plate portions 64 and 65. Alternatively, the shielding portion 62 in the shield member 60 may be one having only the top plate portion 63 or one having only one of the first side plate portion 64 and the second side plate portion 65.

Although the engagement holes 68*a* and 68*b* are formed in the engagement portion 66 of the shield member 60 and the engagement receiving portions 28 and 29 of the bobbin 20 are projections in the transformer 10 illustrated in FIG. 1, the shapes of the engagement portion 66 and the engagement receiving portions 28 and 29 are not limited thereto. For example, the engagement portion of the shield member and the engagement receiving portion of the bobbin can be any engagement structures engaged in a relatively movable manner such as holes, grooves, and projections. In addition, the invention is not limited to the transformer 10 illustrated in the embodiment. The invention is applicable to surface mounting coil devices other than the transformer 10 as well.

What is claimed is:

1. A surface mounting coil device comprising:

a bobbin including a hollow tube-shaped hollow tube portion and a terminal block portion (1) connected to the hollow tube portion and (2) having terminals configured to be installed on a mounting substrate;

a wire member including a winding portion wound around the hollow tube portion, both ends of the wire member being electrically connected to the terminals;

a core (1) including a middle leg portion passing through the hollow tube portion and (2) attached to the bobbin; and a shield member including (1) a shielding portion on an outer circumference of the winding portion, (2) an engagement portion that engages and retains the bobbin such that the shield member and the bobbin are relatively slidable in a mounting direction in which the surface mounting coil device is intended to be mounted on the mounting surface when the engagement portion engages and retains the bobbin and (3) an installation portion connected directly or via the shielding portion to the engagement portion and configured to be installed on the mounting substrate, wherein:

the engagement portion includes an opening with an opening height in the mounting direction; and the bobbin includes at least one protrusion (1) that is received in the opening and (2) having a protrusion height in the mounting direction that is smaller than the opening height.

2. The surface mounting coil device according to claim 1, wherein the shielding portion includes a top plate portion positioned above the winding portion in the mounting direction and first and second side plate portions connected to a first pair of opposite edges of the top plate portion and extending downward in the mounting direction from the top plate portion, and the installation portion includes first and second installation portions connected to lower ends of the first and second side plate portions.

3. The surface mounting coil device according to claim 2, wherein the engagement portion includes first and second engagement portions connected to a second pair of opposite edges of the top plate portion.

4. The surface mounting coil device according claim 1, further comprising:

a tape wound around an outer periphery of the core; wherein the core includes a first core part and a second core part separate from the first core part, and the tape attaches the first core part and the second core part.

5. Electronic equipment comprising:

a mounting substrate including a pair of land patterns, a conductor portion connecting the pair of land patterns, and another land pattern separate from the pair of land patterns;

a bobbin including a hollow tube-shaped hollow tube portion and a terminal block portion (1) connected to the hollow tube portion and (2) having terminals installed in the another land pattern of the mounting substrate;

a wire member including a winding portion wound around the hollow tube portion, both ends of the wire member being electrically connected to the terminals;

a core (1) including a middle leg portion passing through the hollow tube portion and (2) attached to the bobbin; and a shield member including (1) a shielding portion having a top plate portion positioned above the winding portion in a mounting direction in which the bobbin, the wire member, the core and the shield member are intended to be installed on the mounting substrate, (2) an engagement portion that engages and retains the bobbin such that the shield member and the bobbin are relatively slidable in the mounting direction and (3) a pair of installation portions connected directly or via the shielding portion with respect to the engagement portion and installed in the pair of land patterns of the mounting substrate, wherein the top plate portion and the conductor portion sandwich the winding portion from both sides of the mounting direction, the engagement portion includes an opening with an opening height in the mounting direction; and the bobbin includes at least one protrusion (1) that is received in the opening and (2) having a protrusion height in the mounting direction that is smaller than the opening height.

* * * * *